US010715931B2

(12) United States Patent
Merks

(10) Patent No.: US 10,715,931 B2
(45) **Date of Patent: *Jul. 14, 2020**

(54) HEARING ASSISTANCE SYSTEM WITH OWN VOICE DETECTION

(71) Applicant: Starkey Laboratories, Inc., Eden Prairie, MN (US)

(72) Inventor: Ivo Merks, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/235,214

(22) Filed: Dec. 28, 2018

(65) Prior Publication Data

US 2019/0215619 A1 Jul. 11, 2019

Related U.S. Application Data

(63) Continuation of application No. 15/614,200, filed on Jun. 5, 2017, now Pat. No. 10,171,922, which is a (Continued)

(51) Int. Cl.

| | |
|---|---|
| ***H04R 25/00*** | (2006.01) |
| ***G10L 25/78*** | (2013.01) |
| ***H04R 3/00*** | (2006.01) |

(52) U.S. Cl.

CPC ..... *H04R 25/505* (2013.01); *G10L 25/78* (2013.01); *H04R 25/00* (2013.01); *H04R 25/407* (2013.01);

(Continued)

(58) Field of Classification Search

CPC .... H04R 25/505; H04R 25/407; H04R 3/005; H04R 2225/43; H04R 2430/01; H04R 25/00; H04R 25/40

See application file for complete search history.

(56) References Cited

U.S. PATENT DOCUMENTS

| | | | |
|---|---|---|---|
| 4,791,672 | A | 12/1988 | Nunley et al. |
| 5,008,954 | A | 4/1991 | Oppendahl |

(Continued)

FOREIGN PATENT DOCUMENTS

| | | | |
|---|---|---|---|
| EP | 2242289 | B1 | 12/2016 |
| WO | WO-9845937 | A1 | 10/1998 |

(Continued)

OTHER PUBLICATIONS

"U.S. Appl. No. 15/651,459, Non Final Office Action dated Jun. 15, 2018", 11 pgs.

(Continued)

*Primary Examiner* — Sunita Joshi

(74) *Attorney, Agent, or Firm* — Schwegman Lundberg & Woessner, P.A.

(57) ABSTRACT

An example of an apparatus configured to be worn by a person who has an ear and an ear canal includes a first microphone adapted to be worn about the ear of the person, and a second microphone adapted to be worn at a different location than the first microphone. The apparatus includes a sound processor adapted to process signals from the first microphone to produce a processed sound signal, a receiver adapted to convert the processed sound signal into an audible signal to the wearer of the hearing assistance device, and a voice detector to detect the voice of the wearer. The voice detector includes an adaptive filter to receive signals from the first microphone and the second microphone.

20 Claims, 6 Drawing Sheets

Related U.S. Application Data continuation of application No. 14/809,729, filed on Jul. 27, 2015, now Pat. No. 9,699,573, which is a continuation of application No. 13/933,017, filed on Jul. 1, 2013, now Pat. No. 9,094,766, which is a continuation of application No. 12/749,702, filed on Mar. 30, 2010, now Pat. No. 8,477,973.

(60) Provisional application No. 61/165,512, filed on Apr. 1, 2009.

(52) U.S. Cl.
CPC ..... *H04R 3/005* (2013.01); *H04R 2225/021* (2013.01); *H04R 2225/43* (2013.01)

(56) References Cited

U.S. PATENT DOCUMENTS

| | | | |
|---|---|---|---|
| 5,208,867 | A | 5/1993 | Stites, III |
| 5,327,506 | A | 7/1994 | Stites, III |
| 5,426,719 | A | 6/1995 | Franks et al. |
| 5,479,522 | A | 12/1995 | Lindemann et al. |
| 5,550,923 | A | 8/1996 | Hotvet |
| 5,553,152 | A | 9/1996 | Newton |
| 5,659,621 | A | 8/1997 | Newton |
| 5,701,348 | A | 12/1997 | Shennib et al. |
| 5,721,783 | A | 2/1998 | Anderson |
| 5,761,319 | A | 6/1998 | Dar et al. |
| 5,917,921 | A | 6/1999 | Sasaki et al. |
| 5,991,419 | A | 11/1999 | Brander |
| 6,175,633 | B1 | 1/2001 | Morrill et al. |
| 6,639,990 | B1 | 10/2003 | Astrin et al. |
| 6,661,901 | B1 | 12/2003 | Svean et al. |
| 6,671,379 | B2 | 12/2003 | Nemirovski |
| 6,718,043 | B1 | 4/2004 | Boesen |
| 6,728,385 | B2 | 4/2004 | Kvaløy et al. |
| 6,738,482 | B1 | 5/2004 | Jaber |
| 6,738,485 | B1 | 5/2004 | Boesen |
| 6,801,629 | B2 | 10/2004 | Brimhall et al. |
| 7,027,603 | B2 | 4/2006 | Taenzer |
| 7,027,607 | B2 | 4/2006 | Pedersen et al. |
| 7,072,476 | B2 | 7/2006 | White et al. |
| 7,110,562 | B1 | 9/2006 | Feeley et al. |
| 7,242,924 | B2 | 7/2007 | Xie |
| 7,477,754 | B2 | 1/2009 | Rasmussen et al. |
| 7,512,245 | B2 * | 3/2009 | Rasmussen ..... G10L 25/78 381/110 |
| 7,536,020 | B2 | 5/2009 | Fukumoto |
| 7,929,713 | B2 | 4/2011 | Victorian et al. |
| 7,983,907 | B2 | 7/2011 | Visser et al. |
| 8,031,881 | B2 | 10/2011 | Zhang |
| 8,059,847 | B2 | 11/2011 | Nordahn |
| 8,081,780 | B2 | 12/2011 | Goldstein et al. |
| 8,111,849 | B2 | 2/2012 | Tateno et al. |
| 8,116,489 | B2 | 2/2012 | Mejia et al. |
| 8,130,991 | B2 | 3/2012 | Rasmussen et al. |
| 8,331,594 | B2 | 12/2012 | Brimhall et al. |
| 8,391,522 | B2 | 3/2013 | Biundo Lotito et al. |
| 8,391,523 | B2 | 3/2013 | Biundo Lotito et al. |
| 8,477,973 | B2 | 7/2013 | Merks |
| 9,036,833 | B2 | 5/2015 | Victorian et al. |
| 9,094,766 | B2 | 7/2015 | Merks |
| 9,219,964 | B2 | 12/2015 | Merks |
| 9,369,814 | B2 | 6/2016 | Victorian |
| 9,699,573 | B2 | 7/2017 | Merks |
| 9,712,926 | B2 | 7/2017 | Merks |
| 10,171,922 | B2 | 1/2019 | Merks |
| 10,225,668 | B2 | 3/2019 | Merks |
| 2001/0038699 | A1 | 11/2001 | Hou |
| 2002/0034310 | A1 | 3/2002 | Hou |
| 2002/0080979 | A1 | 6/2002 | Brimhall et al. |
| 2002/0141602 | A1 | 10/2002 | Nemirovski |
| 2003/0012391 | A1 | 1/2003 | Armstrong et al. |
| 2003/0165246 | A1 | 9/2003 | Kvaloy et al. |
| 2004/0081327 | A1 | 4/2004 | Jensen |
| 2005/0058313 | A1 | 3/2005 | Victorian et al. |
| 2007/0009122 | A1 | 1/2007 | Debiasio et al. |
| 2007/0098192 | A1 | 5/2007 | Sipkema |
| 2007/0195968 | A1 | 8/2007 | Jaber |
| 2008/0192971 | A1 | 8/2008 | Tateno et al. |
| 2008/0260191 | A1 | 10/2008 | Victorian et al. |
| 2009/0016542 | A1 | 1/2009 | Goldstein et al. |
| 2009/0034765 | A1 | 2/2009 | Boillot et al. |
| 2009/0074201 | A1 | 3/2009 | Zhang |
| 2009/0097681 | A1 | 4/2009 | Puria et al. |
| 2009/0147966 | A1 | 6/2009 | McIntosh et al. |
| 2009/0220096 | A1 | 9/2009 | Usher et al. |
| 2009/0238387 | A1 | 9/2009 | Arndt et al. |
| 2010/0061564 | A1 | 3/2010 | Clemow et al. |
| 2010/0246845 | A1 | 9/2010 | Burge et al. |
| 2010/0260364 | A1 | 10/2010 | Merks |
| 2011/0195676 | A1 | 8/2011 | Victorian et al. |
| 2011/0299692 | A1 | 12/2011 | Rung et al. |
| 2012/0070024 | A1 | 3/2012 | Anderson |
| 2012/0128187 | A1 | 5/2012 | Yamada et al. |
| 2013/0195296 | A1 | 8/2013 | Merks |
| 2014/0010397 | A1 | 1/2014 | Merks |
| 2014/0270230 | A1 | 9/2014 | Oishi et al. |
| 2015/0043765 | A1 | 2/2015 | Merks |
| 2016/0021469 | A1 | 1/2016 | Victorian et al. |
| 2016/0029131 | A1 | 1/2016 | Merks |
| 2016/0192089 | A1 | 6/2016 | Merks |
| 2017/0318398 | A1 | 11/2017 | Merks |
| 2017/0339497 | A1 | 11/2017 | Merks |
| 2019/0200142 | A1 | 6/2019 | Merks |

FOREIGN PATENT DOCUMENTS

| | | | | |
|---|---|---|---|---|
| WO | WO-0207477 | A2 | 1/2002 | |
| WO | WO-2006028587 | A2 | 3/2003 | |
| WO | WO-03073790 | A1 | 9/2003 | |
| WO | WO-2004021740 | A1 | 3/2004 | |
| WO | WO-2004077090 | A1 | 9/2004 | |
| WO | WO-2005004534 | A1 | 1/2005 | |
| WO | WO-2005125269 | A1 | 12/2005 | |
| WO | WO-2009034536 | A2 * | 3/2009 | ..... H04R 25/40 |
| WO | WO-2009034536 | A2 | 3/2009 | |

OTHER PUBLICATIONS

"U.S. Appl. No. 16/290,131, Preliminary Amendment Filed Mar. 8, 2019", 7 pgs.
"U.S. Appl. No. 15/651,459, Notice of Allowance dated Oct. 25, 2018", 5 pgs.
"U.S. Appl. No. 15/651,459,Response Filed Sep. 17, 2018 to Non Final Office Action dated Jun. 15, 2018", 11 pgs.
"U.S. Appl. No. 10/660,454, Advisory Action dated May 20, 2008", 4 pgs.
"U.S. Appl. No. 10/660,454, Final Office Action dated Dec. 27, 2007", 18 pgs.
"U.S. Appl. No. 10/660,454, Non-Final Office Action dated Jul. 27, 2007", 16 pgs.
"U.S. Appl. No. 10/660,454, Response filed Apr. 25, 2008 to Final Office Action dated Dec. 27, 2007", 15 pgs.
"U.S. Appl. No. 10/660,454, Response filed May 9, 2007 to Restriction Requirement dated Apr. 9, 2007", 11 pgs.
"U.S. Appl. No. 10/660,454, Response filed Oct. 15, 2007 to Non-Final Office Action dated Jul. 27, 2007", 17 pgs.
"U.S. Appl. No. 10/660,454, Restriction Requirement dated Apr. 9, 2007", 5 pgs.
"U.S. Appl. No. 12/163,665, Notice of Allowance dated Feb. 7, 2011", 4 pgs.
"U.S. Appl. No. 12/163,665, Notice of Allowance dated Sep. 28, 2010", 9 pgs.
"U.S. Appl. No. 12/749,702, Response filed Aug. 27, 2012 to Non-Final Office Action dated May 25, 2012", 13 pgs.
"U.S. Appl. No. 12/749,702, Final Office Action dated Oct. 12, 2012", 7 pgs.
"U.S. Appl. No. 12/749,702, Non-Final Office Action dated May 25, 2012", 6 pgs.

(56) References Cited

OTHER PUBLICATIONS

"U.S. Appl. No. 12/749,702, Notice of Allowance dated Mar. 4, 2013", 7 pgs.
"U.S. Appl. No. 12/749,702, Response filed Feb. 12, 2013 to Final Office Action dated Oct. 12, 2012", 10 pgs.
"U.S. Appl. No. 13/088,902, Advisory Action dated Nov. 28, 2014", 3 pgs.
"U.S. Appl. No. 13/088,902, Final Office Action dated Sep. 23, 2014", 21 pgs.
"U.S. Appl. No. 16/088,902, Final Office Action dated Nov. 29, 2013", 16 pgs.
"U.S. Appl. No. 13/088,902, Non-Final Office Action dated Mar. 27, 2014", 15 pgs.
"U.S. Appl. No. 13/088,902, Non-Final Office Action dated May 21, 2013", 15 pgs.
"U.S. Appl. No. 16/088,902, Notice of Allowance dated Jan. 20, 2015", 5 pgs.
"U.S. Appl. No. 13/088,902, Response filed Feb. 28, 2014 to Final Office Action dated Nov. 29, 2013", 12 pgs.
"U.S. Appl. No. 13/088,902, Response filed Jun. 27, 2014 to Non-Final Office Action dated Mar. 27, 2014", 13 pgs.
"U.S. Appl. No. 13/088,902, Response filed Aug. 21, 2013 to Non-Final Office Action dated May 21, 2013", 10 pgs.
"U.S. Appl. No. 13/088,902, Response filed Nov. 20, 2014 to Final Office Action dated Sep. 23, 2014", 12 pgs.
"U.S. Appl. No. 13/933,017, Non-Final Office Action dated Sep. 18, 2014", 6 pgs.
"U.S. Appl. No. 13/933,017, Notice of Allowance dated Mar. 20, 2015", 7 pgs.
"U.S. Appl. No. 13/933,017, Response filed Dec. 18, 2014 to Non-Final Office Action dated Sep. 18, 2014", 6 pgs.
"U.S. Appl. No. 14/464,149, Non-Final Office Action dated Apr. 29, 2015", 4 pgs.
"U.S. Appl. No. 14/464,149, Notice of Allowance dated Aug. 14, 2015", 6 pgs.
"U.S. Appl. No. 14/464,149, Response filed Jul. 29, 2015 to Non-Final Office Action dated Apr. 29, 2015", 7 pgs.
"U.S. Appl. No. 14/714,841, Notice of Allowance dated Feb. 12, 2016", 12 pgs.
"U.S. Appl. No. 14/714,841, Preliminary Amendment filed Oct. 13, 2015", 7 pgs.
"U.S. Appl. No. 14/809,729, Corrected Notice of Allowance dated Jun. 1, 2017", 7 pgs.
"U.S. Appl. No. 14/809,729, Non-Final Office Action dated Aug. 24, 2016", 16 pgs.
"U.S. Appl. No. 14/809,729, Notice of Allowance dated Feb. 3, 2017", 10 pgs.
"U.S. Appl. No. 14/809,729, Preliminary Amendment filed Oct. 12, 2015", 6 pgs.
"U.S. Appl. No. 14/809,729, Response filed Nov. 23, 2016 to Non-Final Office Action dated Aug. 24, 2016", 7 pgs.
"U.S. Appl. No. 14/976,711, Non-Final Office Action dated Aug. 26, 2016", 5 pgs.
"U.S. Appl. No. 14/976,711, Notice of Allowability dated May 12, 2017", 9 pgs.
"U.S. Appl. No. 14/976,711, Notice of Allowance dated Mar. 14, 2017", 5 pgs.
"U.S. Appl. No. 14/976,711, Preliminary Amendment filed Mar. 14, 2016", 6 pgs.
"U.S. Appl. No. 14/976,711, Response filed Nov. 23, 2016 to Non-Final Office Action dated Aug. 26, 2016", 7 pgs.
"U.S. Appl. No. 15/614,200, Non-Final Office Action dated Mar. 8, 2018", 10 pgs.
"U.S. Appl. No. 15/614,200, Notice of Allowance dated Aug. 31, 2018", 11 pgs.
"U.S. Appl. No. 15/614,200, Preliminary Amendment filed Aug. 14, 2017", 6 pgs.
"U.S. Appl. No. 15/614,200, Response Filed Jun. 1, 2018 to Non-Final Office Action dated Mar. 8, 2018", 9 pgs.
"Canadian Application Serial No. 2,481,397, Non-Final Office Action dated Dec. 5, 2007", 6 pgs.
"Canadian Application Serial No. 2,481,397, Response filed Jun. 5, 2008 to Office Action dated Dec. 5, 2007", 15 pgs.
"European Application Serial No. 04255520.1, European Search Report dated Nov. 6, 2006", 3 pgs.
"European Application Serial No. 04255520.1, Office Action dated Jun. 25, 2007", 4 pgs.
"European Application Serial No. 04255520.1, Response filed Jan. 7, 2008", 21 pgs.
"European Application Serial No. 10250710.0, Examination Notification Art. 94(3) dated Jun. 25, 2014", 5 pgs.
"European Application Serial No. 10250710.0, Response filed Oct. 13, 2014 to Examination Notification Art. 94(3) dated Jun. 25, 2014", 21 pgs.
"European Application Serial No. 10250710.0, Search Report dated Jul. 20, 2010", 6 Pgs.
"European Application Serial No. 10250710.0, Search Report Response dated Apr. 18, 2011", 16 pg.
"European Application Serial No. 10250710.0, Summons to Attend Oral Proceedings mailed May 12, 2016", 3 pgs.
"European Application Serial No. 15181620.4, Communication Pursuant to Article 94(3) EPC dated Dec. 12, 2016", 6 pgs.
"European Application Serial No. 15181620.4, Extended European Search Report dated Jan. 22, 2016", 8 pgs.
"European Application Serial No. 15181620.4, Response filed Apr. 21, 2017 to Communication Pursuant to Article 94(3) EPC dated Dec. 12, 2016", 33 pgs.
"European Application Serial No. 16206730.0, Extended European Search Report dated Apr. 20, 2017", 8 pgs.
"The New Jawbone: The Best Bluetooth Headset Just Got Better", www.aliph.com, (2008), 3 pages.
Evjen, Peder M., "Low-Power Transceiver Targets Wireless Headsets", Microwaves & RF, (Oct. 2002), 68, 70, 72-73, 75-76, 78-80.
Luo, Fa-Long, et al., "Recent Developments in Signal Processing for Digital Hearing Aids", IEEE Signal Processing Magazine, (Sep. 2006), 103-106.
"U.S. Appl. No. 16/290,131, Non Final Office Action dated Sep. 6, 2019", 7 pgs.
"U.S. Appl. No. 16/290,131, Response filed Dec. 5, 2019 to Non Final Office Action dated Sep. 6, 2019", 8 pgs.
"European Application Serial No. 15181620.4, Communication of a Notice of Opposition mailed Jun. 27, 2019", 40 pgs.

* cited by examiner

HEARING ASSISTANCE SYSTEM WITH OWN VOICE DETECTION

CLAIM OF PRIORITY

The application is a continuation of U.S. application Ser. No. 15/614,200, filed Jun. 5, 2017, now issued as U.S. Pat. No. 10,171,922, which is a continuation of U.S. application Ser. No. 14/809,729, filed Jul. 27, 2015, now issued as U.S. Pat. No. 9,699,573, which application is a continuation of U.S. application Ser. No. 13/933,017, filed on Jul. 1, 2013, now issued as U.S. Pat. No. 9,094,766, which application is a continuation of U.S. application Ser. No. 12/749,702, filed Mar. 30, 2010, now issued as U.S. Pat. No. 8,477,973, which claims the benefit of priority under 35 U.S.C. § 119(e) to U.S. Provisional Application No. 61/165,512, filed Apr. 1, 2009, each of which are hereby incorporated by reference in their entirety.

TECHNICAL FIELD

This application relates to hearing assistance systems, and more particularly, to hearing assistance systems with own voice detection.

BACKGROUND

Hearing assistance devices are electronic devices that amplify sounds above the audibility threshold to is hearing impaired user. Undesired sounds such as noise, feedback and the user's own voice may also be amplified, which can result in decreased sound quality and benefit for the user. It is undesirable for the user to hear his or her own voice amplified. Further, if the user is using an ear mold with little or no venting, he or she will experience an occlusion effect where his or her own voice sounds hollow ("talking in a barrel"). Thirdly, if the hearing aid has a noise reduction/environment classification algorithm, the user's own voice can be wrongly detected as desired speech.

One proposal to detect voice adds a bone conductive microphone to the device. The bone conductive microphone can only be used to detect the user's own voice, has to make a good contact to the skull in order to pick up the own voice, and has a low signal-to-noise ratio. Another proposal to detect voice adds a directional microphone to the hearing aid, and orients the microphone toward the mouth of the user to detect the user's voice. However, the effectiveness of the directional microphone depends on the directivity of the microphone and the presence of other sound sources, particularly sound sources in the same direction as the mouth. Another proposal to detect voice provides a microphone in the ear-canal and only uses the microphone to record an occluded signal. Another proposal attempts to use a filter to distinguish the user's voice from other sound. However, the filter is unable to self correct to accommodate changes in the user's voice and for changes in the environment of the user.

SUMMARY

The present subject matter provides apparatus and methods to use a hearing assistance device to detect a voice of the wearer of the hearing assistance device. Embodiments use an adaptive filter to provide a self-correcting voice detector, capable of automatically adjusting to accommodate changes in the wearer's voice and environment.

Examples are provided, such as an apparatus configured to be worn by a wearer who has an ear and an ear canal. The apparatus includes a first microphone adapted to be worn about the ear of the person, a second microphone adapted to be worn about the ear canal of the person and at a different location than the first microphone, a sound processor adapted to process signals from the first microphone to produce a processed sound signal, and a voice detector to detect the voice of the wearer. The voice detector includes an adaptive filter to receive signals from the first microphone and the second microphone.

Another example of an apparatus includes a housing configured to be worn behind the ear or over the ear, a first microphone in the housing, and an ear piece configured to be positioned in the ear canal, wherein the ear piece includes a microphone that receives sound from the outside when positioned near the ear canal. Various voice detection systems employ an adaptive filter that receives signals from the first microphone and the second microphone and detects the voice of the wearer using a peak value for coefficients of the adaptive filter and an error signal from the adaptive filter.

The present subject matter also provides methods for detecting a voice of a wearer of a hearing assistance device where the hearing assistance device includes a first microphone and a second microphone. An example of the method is provided and includes using a first electrical signal representative of sound detected by the first microphone and a second electrical signal representative of sound detected by the second microphone as inputs to a system including an adaptive filter, and using the adaptive filter to detect the voice of the wearer of the hearing assistance device.

This Summary is an overview of some of the teachings of the present application and is not intended to be an exclusive or exhaustive treatment of the present subject matter. Further details about the present subject matter are found in the detailed description. The scope of the present invention is defined by the appended claims and their equivalents.

DETAILED DESCRIPTION

The following detailed description refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Various embodiments disclosed herein provide a self-correcting voice detector, capable of reliably detecting the presence of the user's own voice through automatic adjustments that accommodate changes in the user's voice and environment. The detected voice can be used, among other things, to reduce the amplification of the user's voice, control an anti-occlusion process and control an environment classification process.

The present subject matter provides, among other things, an "own voice" detector using two microphones in a standard hearing assistance device. Examples of standard hearing aids include behind-the-ear (BTE), over-the-ear (OTE), and receiver-in-canal (RIC) devices. It is understood that RIC devices have a housing adapted to be worn behind the ear or over the ear. Sometimes the RIC electronics housing is called a BTE housing or an OTE housing. According to various embodiments, one microphone is the microphone as usually present in the standard hearing assistance device, and the other microphone is mounted in an ear bud or ear mold near the user's ear canal. Hence, the microphone is directed to detection of acoustic signals outside and not inside the ear canal. The two microphones can be used to create a directional signal.

Figure 1A:
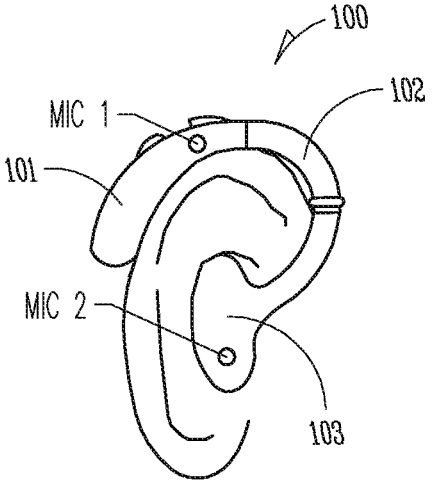
FIGS. 1A and 1B illustrate a hearing assistance device with a voice detector according to one embodiment of the present subject matter.
Figure 1B:
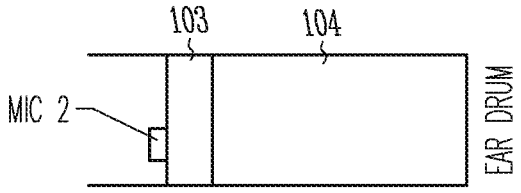

FIG. 1A illustrates a hearing assistance device with a voice detector according to one embodiment of the present subject matter. The figure illustrates an ear with a hearing assistance device 100, such as a hearing aid. The illustrated hearing assistance device includes a standard housing 101 (e.g. behind-the-ear (BTE) or on-the-ear (OTE) housing) with an optional ear hook 102 and an ear piece 103 configured to fit within the ear canal. A first microphone (MIC 1) is positioned in the standard housing 101, and a second microphone (MIC 2) is positioned near the ear canal 104 on the air side of the ear piece. FIG. 1B schematically illustrates a cross section of the ear piece 103 positioned near the ear canal 104, with the second microphone on the air side of the ear piece 103 to detect acoustic signals outside of the ear canal.

Figure 2:
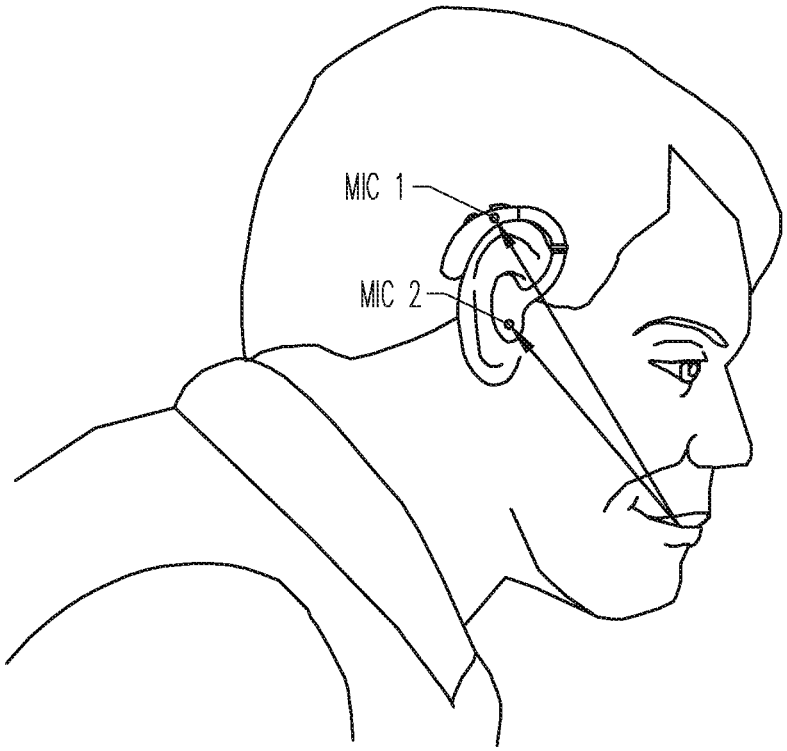
FIG. 2 demonstrates how sound can travel from the user's mouth to the first and second microphones illustrated in FIG. 1A.

Other embodiments may be used in which the first microphone (M1) is adapted to be worn about the ear of the person and the second microphone (M2) is adapted to be worn about the ear canal of the person. The first and second microphones are at different locations to provide a time difference for sound from a user's voice to reach the microphones. As illustrated in FIG. 2, the sound vectors representing travel of the user's voice from the user's mouth to the microphones are different. The first microphone (MIC 1) is further away from the mouth than the second microphone (MIC 2). Sound received by MIC 2 will be relatively high amplitude and will be received slightly sooner than sound detected by MIC 1. And when the wearer is speaking, the sound of the wearer's voice will dominate the sounds received by both MIC 1 and MIC 2. The differences in received sound can be used to distinguish the own voice from other sound sources.

Figure 3:
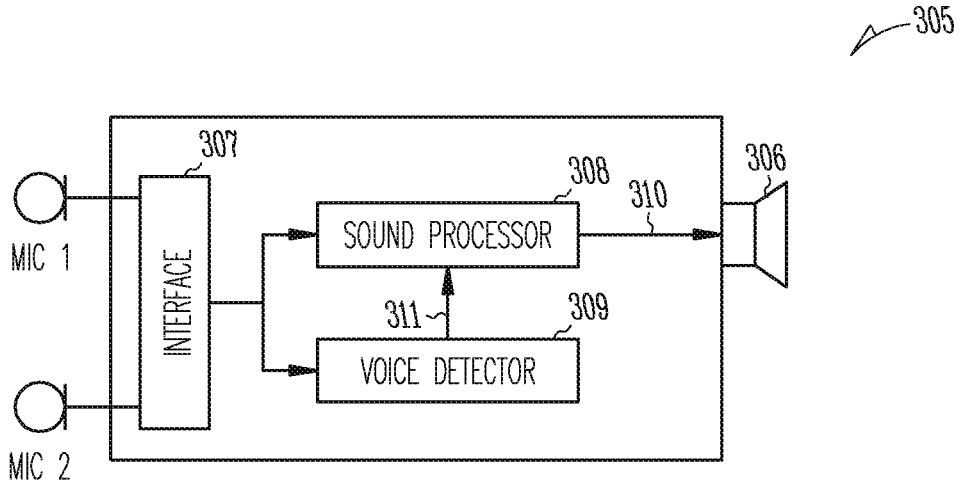
FIG. 3 illustrates a hearing assistance device according to one embodiment of the present subject matter.

FIG. 3 illustrates a hearing assistance device according to one embodiment of the present subject matter. The illustrated device 305 includes the first microphone (MIC 1), the second microphone (MIC 2), and a receiver (speaker) 306. It is understood that different types of microphones can be employed in various embodiments. In one embodiment, each microphone is an omnidirectional microphone. In one embodiment, each microphone is a directional microphone. In various embodiments, the microphones may be both directional and omnidirectional. Various order directional microphones can be employed. Various embodiments incorporate the receiver in a housing of the device (e.g. behind-the-ear or on-the-ear housing). A sound conduit can be used to direct sound from the receiver toward the ear canal. Various embodiments use a receiver configured to fit within the user's ear canal. These embodiments are referred to as receiver-in-canal (RIC) devices.

A digital sound processing system 308 processes the acoustic signals received by the first and second microphones, and provides a signal to the receiver 306 to produce an audible signal to the wearer of the device 305. The illustrated digital sound processing system 308 includes an interface 307, a sound processor 308, and a voice detector 309. The illustrated interface 307 converts the analog signals from the first and second microphones into digital signals for processing by the sound processor 308 and the voice detector 309. For example, the interface may include analog-to-digital converters, and appropriate registers to hold the digital signals for processing by the sound processor and voice detector. The illustrated sound processor 308 processes a signal representative of a sound received by one or both of the first microphone and/or second microphone into a processed output signal 310, which is provided to the receiver 306 to produce the audible signal. According to various embodiments, the sound processor 308 is capable of operating in a directional mode in which signals representative of sound received by the first microphone and sound received by the second microphone are processed to provide the output signal 310 to the receiver 306 with directionality.

The voice detector 309 receives signals representative of sound received by the first microphone and sound received by the second microphone. The voice detector 309 detects the user's own voice, and provides an indication 311 to the sound processor 308 regarding whether the user's own voice is detected. Once the user's own voice is detected any number of possible other actions can take place. For example, in various embodiments when the user's voice is detected, the sound processor 308 can perform one or more of the following, including but not limited to reduction of the amplification of the user's voice, control of an anti-occlusion process, and/or control of an environment classification process. Those skilled in the art will understand that other processes may take place without departing from the scope of the present subject matter.

In various embodiments, the voice detector 309 includes an adaptive filter. Examples of processes implemented by adaptive filters include Recursive Least Square error (RLS), Least Mean Squared error (LMS), and Normalized Least Mean Square error (NLMS) adaptive filter processes. The desired signal for the adaptive filter is taken from the first microphone (e.g., a standard behind-the-ear or over-the-ear microphone), and the input signal to the adaptive filter is taken from the second microphone. If the hearing aid wearer is talking, the adaptive filter models the relative transfer function between the microphones. Voice detection can be performed by comparing the power of the error signal to the power of the signal from the standard microphone and/or looking at the peak strength in the impulse response of the filter. The amplitude of the impulse response should be in a certain range in order to be valid for the own voice. If the user's own voice is present, the power of the error signal will be much less than the power of the signal from the standard microphone, and the impulse response has a strong peak with an amplitude above a threshold (e.g. above about 0.5 for normalized coefficients). In the presence of the user's own voice, the largest normalized coefficient of the filter is expected to be within the range of about 0.5 to about 0.9. Sound from other noise sources would result in a much smaller difference between the power of the error signal and the power of the signal from the standard microphone, and a small impulse response of the filter with no distinctive peak.

Figure 4:
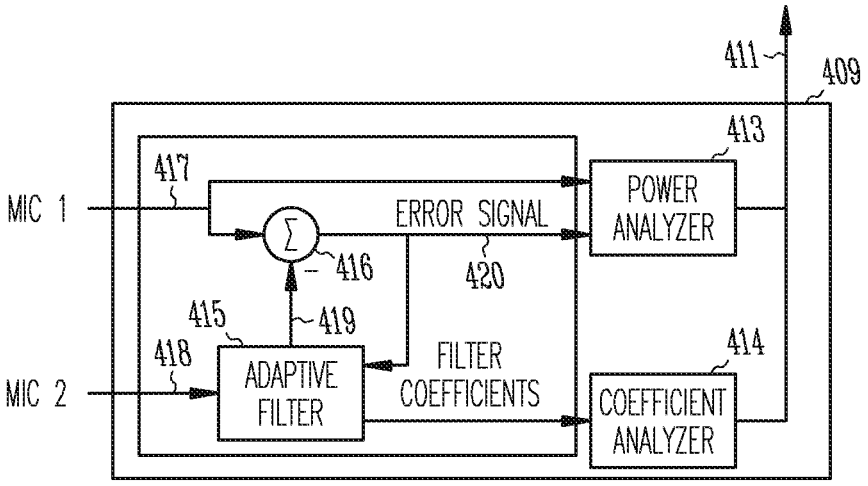
FIG. 4 illustrates a voice detector according to one embodiment of the present subject matter.

FIG. 4 illustrates a voice detector according to one embodiment of the present subject matter. The illustrated voice detector 409 includes an adaptive filter 412, a power analyzer 413 and a coefficient analyzer 414. The output 411 of the voice detector 409 provides an indication to the sound processor indicative of whether the user's own voice is detected. The illustrated adaptive filter includes an adaptive filter process 415 and a summing junction 416. The desired signal 417 for the filter is taken from a signal representative of sound from the first microphone, and the input signal 418 for the filter is taken from a signal representative of sound from the second microphone. The filter output signal 419 is subtracted from the desired signal 417 at the summing junction 416 to produce an error signal 420 which is fed back to the adaptive filter process 415.

The illustrated power analyzer 413 compares the power of the error signal 420 to the power of the signal representative of sound received from the first microphone. According to various embodiments, a voice will not be detected unless the power of the signal representative of sound received from the first microphone is much greater than the power of the error signal. For example, the power analyzer 413 compares the difference to a threshold, and will not detect voice if the difference is less than the threshold.

The illustrated coefficient analyzer 414 analyzes the filter coefficients from the adaptive filter process 415. According to various embodiments, a voice will not be detected unless a peak value for the coefficients is significantly high. For example, some embodiments will not detect voice unless the largest normalized coefficient is greater than a predetermined value (e.g. 0.5).

Figure 5:
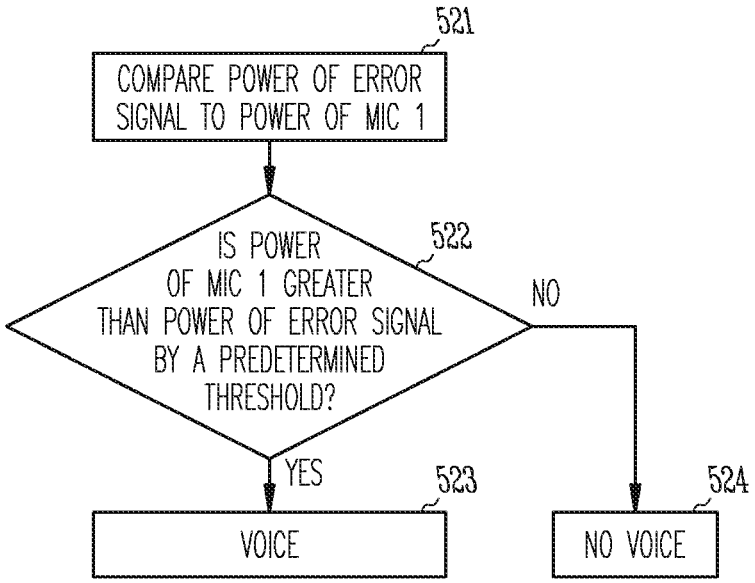
FIGS. 5-7 illustrate various processes for detecting voice that can be used in various embodiments of the present subject matter.
Figure 6:
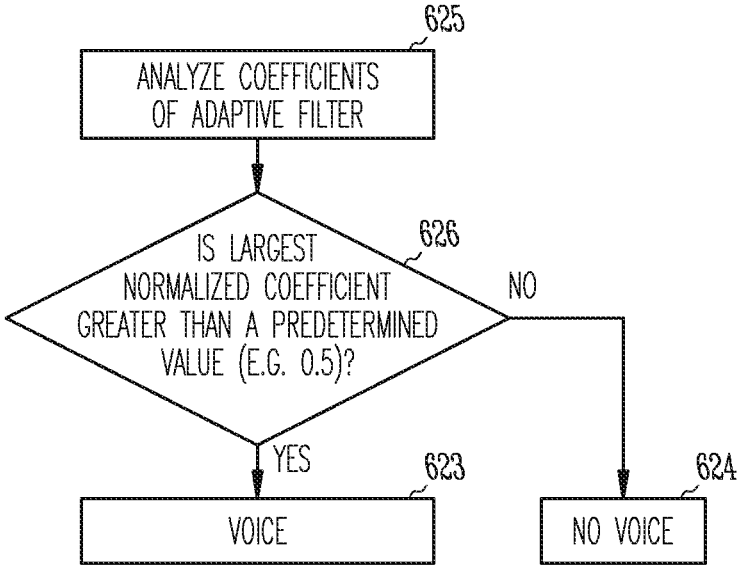
Figure 7:
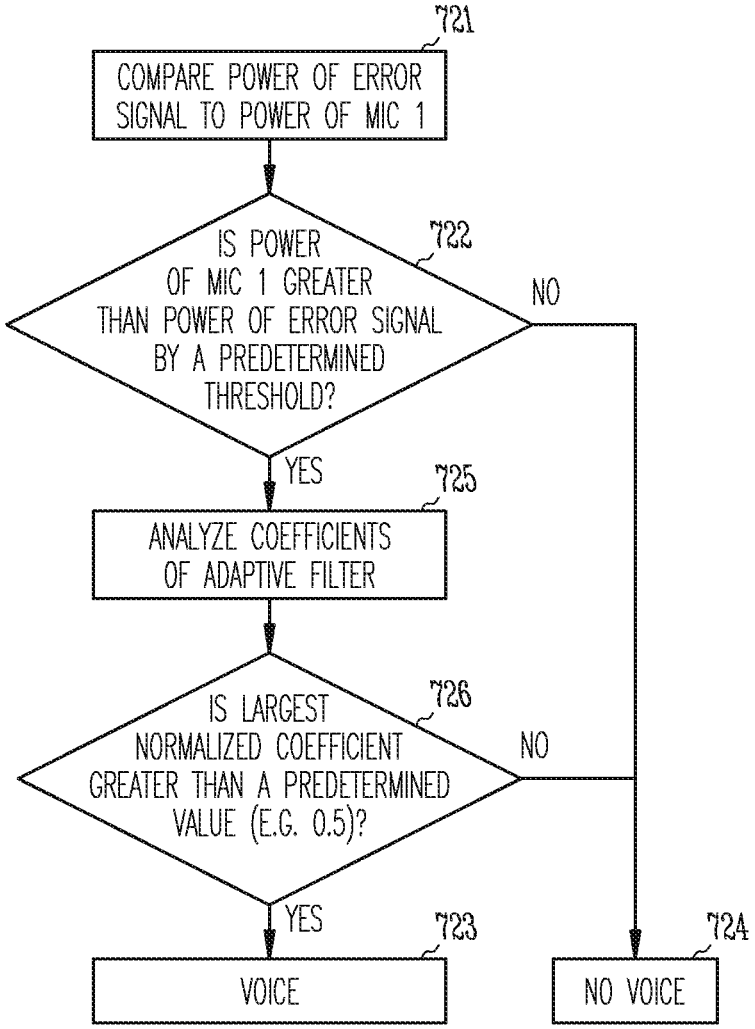

FIGS. 5-7 illustrate various processes for detecting voice that can be used in various embodiments of the present subject matter. In FIG. 5, as illustrated at 521, the power of the error signal from the adaptive filter is compared to the power of a signal representative of sound received by the first microphone. At 522, it is determined whether the power of the first microphone is greater than the power of the error signal by a predetermined threshold. The threshold is selected to be sufficiently high to ensure that the power of the first microphone is much greater than the power of the error signal. In some embodiments, voice is detected at 523 if the power of the first microphone is greater than the power of the error signal by a predetermined threshold, and voice is not detected at 524 if the power of the first microphone is greater than the power of the error signal by a predetermined threshold.

In FIG. 6, as illustrated at 625, coefficients of the adaptive filter are analyzed. At 626, it is determined whether the largest normalized coefficient is greater than a predetermined value, such as greater than 0.5. In some embodiments, voice is detected at 623 if the largest normalized coefficient is greater than a predetermined value, and voice is not detected at 624 if the largest normalized coefficient is not greater than a predetermined value.

In FIG. 7, as illustrated at 721, the power of the error signal from the adaptive filter is compared to the power of a signal representative of sound received by the first microphone. At 722, it is determined whether the power of the first microphone is greater than the power of the error signal by a predetermined threshold. In some embodiments, voice is not detected at 724 if the power of the first microphone is not greater than the power of the error signal by a predetermined threshold. If the power of the error signal is too large, then the adaptive filter has not converged. In the illustrated method, the coefficients are not analyzed until the adaptive filter converges. As illustrated at 725, coefficients of the adaptive filter are analyzed if the power of the first microphone is greater than the power of the error signal by a predetermined threshold. At 726, it is determined whether the largest normalized coefficient is greater than a predetermined value, such as greater than 0.5. In some embodiments, voice is not detected at 724 if the largest normalized coefficient is not greater than a predetermined value. Voice is detected at 723 if the power of the first microphone is greater than the power of the error signal by a predetermined threshold and if the largest normalized coefficient is greater than a predetermined value.

Figure 8:
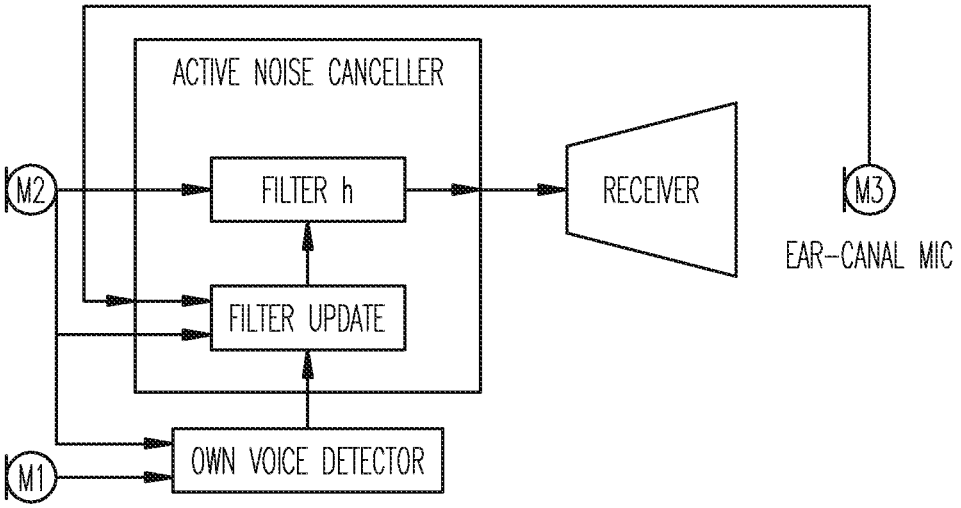
FIG. 8 illustrates one embodiment of the present subject matter with an "own voice detector" to control active noise canceller for occlusion reduction.

FIG. 8 illustrates one embodiment of the present subject matter with an "own voice detector" to control active noise canceller for occlusion reduction. The active noise canceller filters microphone M2 with filter h and sends the filtered signal to the receiver. The microphone M2 and the error microphone M3 (in the ear canal) are used to calculate the filter update for filter h. The own voice detector, which uses microphone M1 and M2, is used to steer the stepsize in the filter update.

Figure 9:
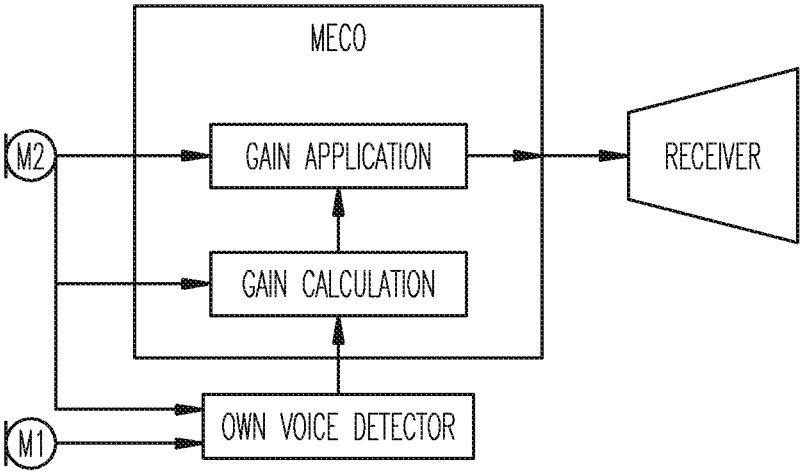
FIG. 9 illustrates one embodiment of the present subject matter offering a multichannel expansion, compression and output control limiting algorithm (MECO).

FIG. 9 illustrates one embodiment of the present subject matter offering a multichannel expansion, compression and output control limiting algorithm (MECO) which uses the signal of microphone M2 to calculate the desired gain and subsequently applies that gain to microphone signal M2 and then sends the amplified signal to the receiver. Additionally, the gain calculation can take into account the outcome of the own voice detector (which uses M1 and M2) to calculate the desired gain. If the wearer's own voice is detected, the gain in the lower channels (typically below 1 KHz) will be lowered to avoid occlusion. Note: the MECO algorithm can use microphone signal M1 or M2 or a combination of both.

Figure 10:
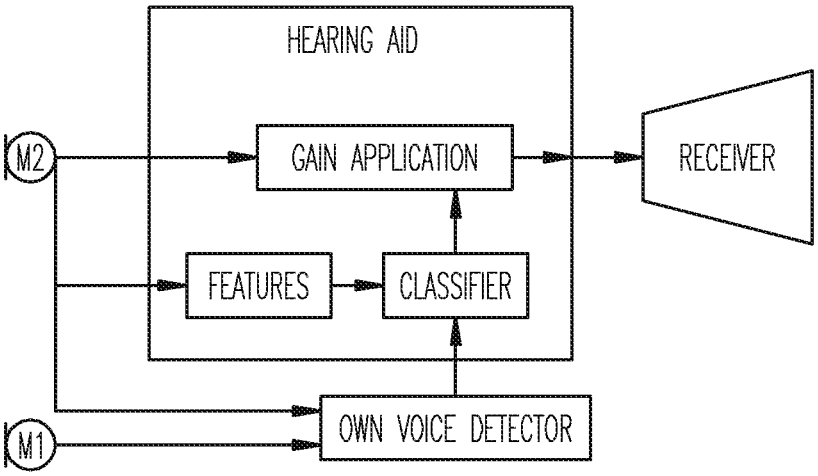
FIG. 10 illustrates one embodiment of the present subject matter which uses an "own voice detector" in an environment classification scheme.

FIG. 10 illustrates one embodiment of the present subject matter which uses an "own voice detector" in an environment classification scheme. From the microphone signal M2, several features are calculated. These features together with the result of the own voice detector, which uses M1 and M2, are used in a classifier to determine the acoustic environment. This acoustic environment classification is used to set the gain in the hearing aid. In various embodiments, the hearing aid may use M2 or M1 or M1 and M2 for the feature calculation.

The present subject matter includes hearing assistance devices, and was demonstrated with respect to BTE, OTE, and RIC type devices, but it is understood that it may also be employed in cochlear implant type hearing devices. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. An apparatus configured to be worn by a wearer having an ear with an ear canal, the apparatus comprising:

a first microphone configured to produce a first microphone signal;

a second microphone configured to produce a second microphone signal;

a voice detector including an adaptive filter configured to produce output information using the first microphone signal and the second microphone signal, the output information allowing for a voice of the wearer to be distinguished from other sound sources, the voice detector configured to detect the voice of the wearer using the output information and to produce an indication of detection of the voice of the wearer in response to the voice of the wearer being detected; and a sound processor configured to calculate a gain based on whether the indication of detection of the voice of the wearer is present and to produce an audio output signal using the gain.

2. The apparatus of claim 1, wherein the sound processor is configured to control processes using the indication of detection of the voice of the wearer, the processes including amplification and at least one of anti-occlusion or environment classification.

3. The apparatus of claim 1, wherein the output information comprises at least one of coefficients of the adaptive filter or an error signal, and the voice detector is configured to detect the voice of the wearer using the at least one of the coefficients of the adaptive filter or the error signal.

4. The apparatus of claim 3, wherein the adaptive filter is configured to implement a recursive least square error process, a least mean square error process, or a normalized least mean square error process.

5. The apparatus of claim 3, wherein the sound processor is configured to provide the audible signal with directionality using the first microphone signal and the second microphone signal.

6. The apparatus of claim 3, wherein the output information comprises the coefficients of the adaptive filter, and the voice detector is configured to detect the voice of the wearer by comparing a peak value of the coefficients of the adaptive filter to a threshold.

7. The apparatus of claim 3, wherein the voice detector is configured to produce the error signal by subtracting an output of the adaptive filter from the first microphone signal and to detect the voice of the wearer by comparing a power of the error signal to a power of the first microphone signal.

8. The apparatus of claim 1, wherein the sound processor is configured to calculate gain based on the second microphone signal and whether the indication of detection of the voice of the wearer is present and to apply the gain to the second microphone signal to produce the audio output signal.

9. The apparatus of claim 8, wherein the first microphone and the second microphone are positioned in the apparatus for placement at different locations to provide a time difference for the voice of the wearer to reach the first and second microphones when the apparatus is worn by the wearer.

10. The apparatus of claim 9, comprising:

a housing configured to be worn over or behind the ear; and an earpiece configured to fit within the ear canal, wherein the first microphone is mounted on the housing, and the second microphone is mounted on the ear piece in a location outside the ear canal when the apparatus is worn by the wearer.

11. A method for operating a device configured to lie worn by a wearer, the method comprising:

receiving a first microphone signal from a first microphone;

receiving a second microphone signal from a second microphone;

producing output information using an adaptive filter receiving the first microphone signal and the second microphone signal, the output information allowing for a voice of the wearer to be distinguished from other sound sources;

detecting the voice of the wearer using the output information;

producing an indication of detection of the voice of the wearer in response to the voice of the wearer being detected;

calculating a gain using the second microphone signal and the indication of detection of the voice of the wearer; and producing an audio output signal using the second microphone signal and the gain indication of detection of the voice of the wearer.

12. The method of claim 11, wherein producing the audio output signal comprises controlling amplification using the indication of detection of the voice of the wearer.

13. The method of claim 11, wherein producing the audio output signal comprises controlling active noise cancellation for occlusion reduction using the indication of detection of the voice of the wearer.

14. The method of claim 11, wherein producing the audio output signal comprises:

classifying an acoustic environment using the indication of detection of the voice of the wearer; and setting the gain based on the classification of the acoustic environment.

15. A method for operating a device configured to be worn by a wearer, the method comprising:

positioning a first microphone and a second microphone at different locations to provide a time difference a voice of the wearer to reach the first and second microphones when the device is worn by the wearer;

receiving a first microphone signal from the first microphone;

receiving a second microphone signal from the second microphone;

producing output information using an adaptive filter receiving the first microphone signal and the second microphone signal, the output information allowing for the voice of the wearer to be distinguished from other sound sources;

detecting the voice of the wearer using the output information;

producing an indication of detection of the voice of the wearer in response to the voice of the wearer being detected; and producing an audio output signal using the first microphone signal, the second microphone signal, and the indication of detection of the voice of the wearer.

16. The method of claim 15, wherein producing output information using an adaptive filter comprises configuring the adaptive filter to model a relative transfer function between the first microphone and the second microphone, and detecting the voice of the wearer comprises analyzing an impulse response of the relative transfer function.

17. The method of claim 15, wherein producing output information using an adaptive filter comprises producing an error signal of the adaptive filter using the first microphone signal and comparing a power of the error signal to a power of the first microphone signal.

18. The method of claim 15, further comprising configuring the adaptive filter to implement a recursive least square error process.

19. The method of claim 15, further comprising configuring the adaptive filter to implement a least mean square error process.

20. The method of claim 15, further comprising configuring the adaptive filter to implement a normalized least mean square error process.

* * * * *